US005332327A

United States Patent [19]

Gillum

[11] Patent Number: 5,332,327

[45] Date of Patent: Jul. 26, 1994

[54] D RING BINDER

[75] Inventor: Steve Gillum, Fairhaven, Mass.

[73] Assignee: U.S. Ring Binder, New Bedford, Mass.

[21] Appl. No.: 763,520

[22] Filed: Sep. 23, 1991

[51] Int. Cl.[5] ..... B42F 13/26; B42F 13/42

[52] U.S. Cl. ..... 402/31; 402/80 R; 402/502

[58] Field of Search ..... 402/31, 80 R, 80 P, 402/502

[56] References Cited

U.S. PATENT DOCUMENTS

| | | | |
|---|---|---|---|
| 267,890 | 11/1882 | Herzberg . | |
| 331,259 | 11/1885 | Shannon . | |
| 379,049 | 3/1888 | Chappell . | |
| 474,776 | 5/1892 | Henson . | |
| 509,972 | 12/1893 | Tiffany et al. . | |
| 1,537,502 | 5/1925 | Sellew . | |
| 1,915,140 | 6/1933 | Watson . | |
| 2,265,822 | 12/1941 | Spalding . | |
| 2,460,718 | 2/1949 | Stevens . | |
| 3,263,687 | 8/1966 | Weichert . | |
| 4,415,290 | 11/1983 | Ohminato . | |
| 4,552,478 | 11/1985 | Cohen | 402/31 X |

FOREIGN PATENT DOCUMENTS

| | | | |
|---|---|---|---|
| 686769 | 1/1940 | Fed. Rep. of Germany . | |
| 1028992 | 11/1950 | France . | |
| 181288 | 11/1962 | Sweden . | |
| 410858 | 10/1966 | Switzerland | 402/31 |
| 12858 | of 1899 | United Kingdom | 402/31 |
| 119017 | 4/1970 | United Kingdom . | |

OTHER PUBLICATIONS

Cardinal Slatn-D Brochure and photographs.
Photographs of binder from ICLE Handbook.
Conception by Another.

*Primary Examiner*—Paul A. Bell
*Attorney, Agent, or Firm*—Hill, Steadman & Simpson

[57] ABSTRACT

A ring binder having D-shaped rings wherein the rings, when opened, position a generally straight leg of the D-shape in a vertical orientation with respect to a horizontal bottom cover panel of the binder. The straight leg has a short turned end portion which allows for simple vertical loading of pages onto the rings. The arrangement provides for greater efficiency at loading multiple pages onto a ring binder in the factory, as well as replacing pages in the ring binder by the consumer. A plurality of D-shaped rings can be used in an arrangement wherein the ring carrier can be mounted on the bottom cover, rather than mounted onto a spine panel of the ring binder. By arranging the ring carrier on the bottom cover rather than the spine, the top and bottom cover members can be made of shorter width, resulting in a savings of material of manufacture.

21 Claims, 1 Drawing Sheet

D RING BINDER

BACKGROUND OF THE INVENTION

1. Field of the Invention

This invention relates to ring binders, in particular ring binders having a plurality of openable rings for holding leaves of paper or pages thereon.

In a conventional ring binder, a plurality of rings are flexibly held in alignment on an inside spine portion of a tri-fold cover. The rings are in a circular shape and spreadable from a top junction for threading or inserting the pages thereon. A drawback to this configuration is that threading of the pages thereon must be accomplished with a swinging or rotational displacement of the pages to thread around the curvature of the open half ring. In a conventional D ring binder the substantially straight portion of the "D" has its upper end portion gradually curved to meet the distal end of the arcuate half of the ring. The horizontal profile of the conventional D ring binder is still too great for vertical loading of conventionally punched pages which usually have 5/16" diameter punched holes. Therefore, even with a conventional D, some pivoting of the pages is required for loading.

In photo album manufacture, the albums are shipped with magnetic pages already installed. When installing pages at the factory, operators must accomplish this task manually and because of the movement of their wrists, operators have experienced wrist and arm problems, particularly with carpal tunnel. Machine threading of the pages onto open circular rings is also made more complicated because of the curvature of the rings.

SUMMARY OF THE INVENTION

The present invention provides for the easy assembly of pages onto opened rings either manually by operators or by an automatic feeding device.

The present invention utilizes a unique "D" shaped ring having a short turned end and mounted to an inside surface of a binder cover. The substantially straight leg of the "D" is arranged to be perpendicular to the open cover of the ring binder when the ring is open. With this configuration and shaping the pages can be installed downwardly in approaching planarly parallel relation with the opened cover.

Additionally, by using the "D" shaped ring, mounted to a bottom cover portion of a tri-fold binder rather than a conventional ring mounted to the spine portion, the cover can be reduced in overall width as the projection of the pages from the "D" ring outwardly with the cover in the closed condition does not extend as far compared to a conventional ring-on-spine binder. A 9¾" wide binder cover can be reduced to 9⅜" cover resulting in a ⅜" savings on the width of the cover.

DETAILED DESCRIPTION OF THE PREFERRED EMBODIMENTS

Figures 1, 2, 3, 4, 5:
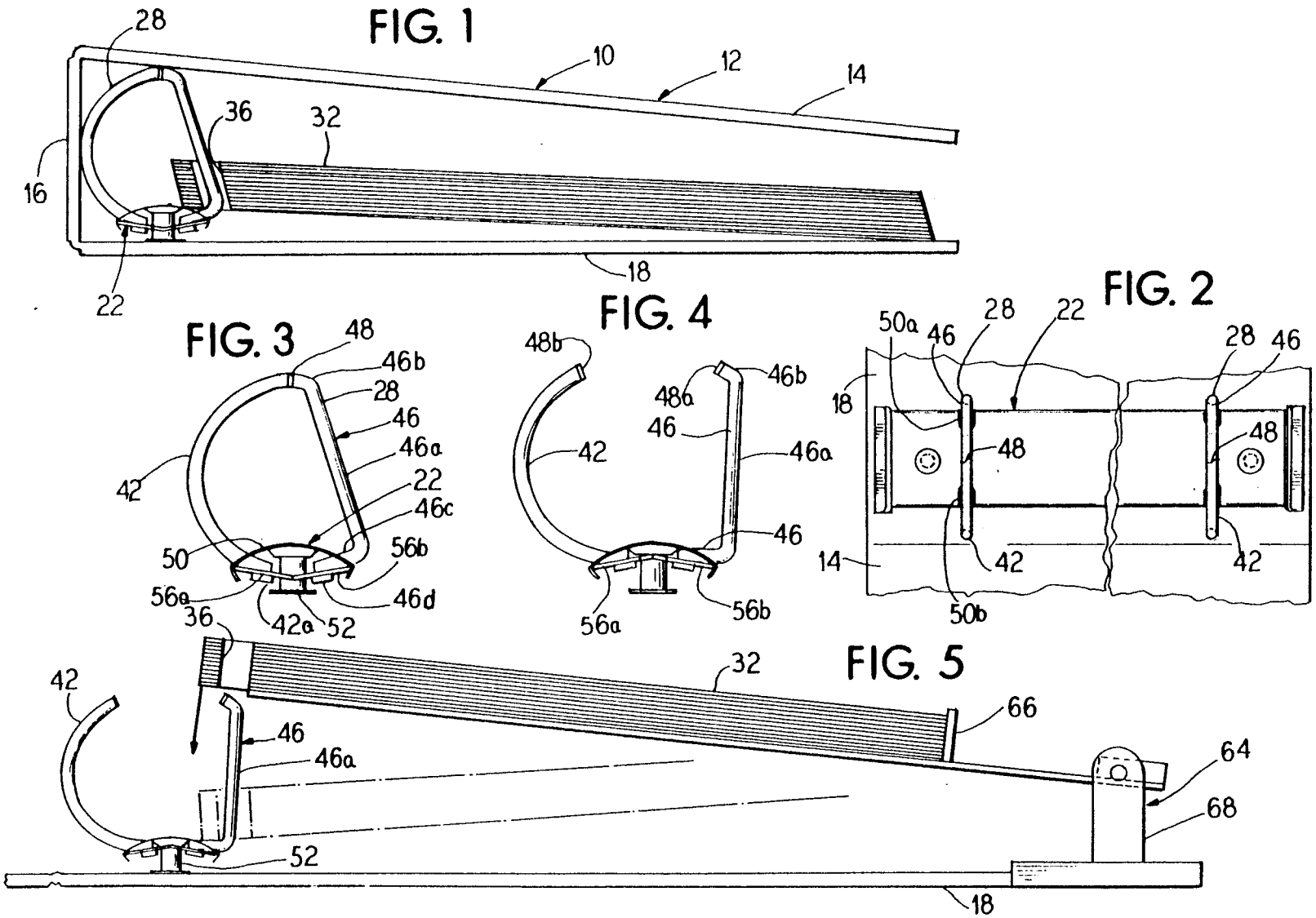
FIG. 1 is a sectional view of a ring binder of the present invention.
FIG. 2 is a partial plan view of the ring binder of FIG. 1.
FIG. 3 is an enlarged sectional view of a ring of the ring binder of FIG. 1.
FIG. 4 is a sectional view of the ring of FIG. 3 but in an open condition.
FIG. 5 is a sectional view of the ring binder of FIG. 1 with the binder cover open and the rings open, in a condition for loading pages thereon.

FIG. 1 shows a ring binder 10 in a closed condition. The ring binder comprises a tri-fold cover 12 having a top panel 14 hingedly adjoining a spine panel 16 which is hingedly connected to a bottom panel 18. Mounted on an inside surface of the bottom panel 18 is a ring carrier 22, mounted adjacent to the spine panel 16. The ring carrier 22 holds thereon a plurality of rings 28. Threaded onto the rings 28 are shown pages 32 having punched or formed apertures 36 corresponding to the number and location of the rings 28.

FIG. 2 shows a plan view of the ring binder of FIG. 1 with the top panel 12 and the spine panel 16 opened and laid flat co-planar with the bottom panel 18. The rings 28 are shown as two rings, however, any number of rings are encompassed by the present invention.

FIG. 3 shows an enlarged view of a ring 28 mounted into the ring carrier 22. The ring 28 comprises a left arm 42 comprising generally a half circular shape. A right arm 46 comprises a straight length portion **46*a* with an offset top end portion 46*b* and an offset bottom end portion 46*c*. The right arm 46 mates at a seam 48 with the left arm 42. The seam 48** is a conventional type of seam or juncture used in ring binders such as a serrated or irregular shaped interlocking seam.

The ring carrier 22 comprises a flexible cover member 50 mounted to the bottom panel 18 by use of special elevated rivets 52 which hold the ring carrier 22 and the rings 28 elevated from the bottom panel 18. This clearance allows for movement of the rings 28 during opening and closing.

The ring arms 42, 46 extend beneath the cover member 50 and are turned at their bottom ends to engage into a pair of hinged leaves **56*a*, 56*b*. The hinged leaves 56*a*, 56*b* are surrounded in clasping fashion by the cover member 50. The hinged leaves form a downwardly extending "V" shape when the ring is in a closed condition as shown in FIG. 3, and can be inverted upwardly when the ring is opened as shown in FIG. 4. The leaves 56*a*, 56*b* can generally run the length of the ring carrier and hold a plurality of rings thereon along their length. The left arm 42 inserts through the left leaf 56*a* and has a knob end 42*a* which inserts through the leaf and holds the left arm 42 thereon. The right arm 46 has an identically configured knob end 46*d* which inserts through the right leaf 56*b* and holds the right arm 46** thereon.

The left arm 42 and the right arm 46 proceed through notches **50*a*, 50*b* respectively in the cover member 50 to overlie the hinged leaves 56*a*, 56*b*. This configuration with respect to the right arm 46 is an improvement over the prior art in one respect. In at least one conventional D ring binder the right arm 46 extends completely below the cover 50 and the right hinged leaf 56*b* and extends through the right hinged leaf 56*b* from below. This configuration can allow some edges of pages to drop down and become trapped or pinched between the cover 50 and the offset portion 46*c* of the rings. In applicant's embodiment, pages held onto the right ring 46 are arranged to remain on top of the cover member 50** and such pinching or trapping is prevented.

FIG. 4 shows the ring of FIG. 3, but in a fully opened position. The hinged leaves **56*a*, 56*b* have been inverted upwardly and the left arm 42 separated from the right arm 46. The cover member 50 has flexed outwardly slightly to accommodate the increased overall width of the hinged leaves 56***a*, 56*b*. The cover member 50 resiliently holds the hinged leaves 56*a*, 56*b* in either condition of FIG. 3 or the condition of FIG. 4. In the opened condition of FIG. 4, the right arm straight length portion 46*a* has accomplished a generally vertical alignment. The right arm 46 has its offset top end portion 46*b* turned toward the left arm 42 which allows the substantially straight right arm 46 to mate with the curved left arm 42 at the seam 48. The seam 48 comprises matching serpentine profiles 48*a*, 48*b* on the ring arms 42, 46. This serpentine profile is shown more clearly in FIG. 2.

To ease loading of pages (see FIG. 5) onto the right arm 46 the top end portion 46*b* has a horizontal profile dimension D of approximately ¼". Thus, as long as the apertures 36 of the pages are slightly larger than ¼" a minimum of manipulation is required to downwardly thread the pages 32 over the right arm 46. The typical size of an aperture on a punched hole in a loose leaf page is 5/16" diameter.

FIG. 5 amply demonstrates the advantage of the present invention. A page loading device 64 having a loading tray 66 mounted to a stand 68 allows a plurality of pages 32 to be lowered generally vertically downward over the right arm 46 which is aligned in a generally vertical condition with respect to the bottom panel 18. In this embodiment, the tray 66 is swung downward at a slight pivoting motion, but is generally vertical nonetheless. For manual loading of pages, the movement of the pages can be strictly vertically downward.

Although the present invention has been described with reference to a specific embodiment, those of skill in the art will recognize that changes may be made thereto without departing from the scope and spirit of the invention as set forth in the appended claims.

I claim:

1. In a D-ring binder having a ring for holding a plurality of pages having ring engaging apertures, wherein said ring is held on a ring carrier, said ring carrier itself held on an inside surface of a cover of a ring binder, the ring having:

a first ring arm portion extending from a first base end at said ring carrier upwardly away from said inside surface of said cover of said ring binder and terminating in a first distal end; and a second ring arm portion, said second ring arm portion extending from a second base end at said ring carrier upwardly away from said inside surface of said cover and terminating in a second distal end, said second ring arm portion hingedly held onto said ring carrier and pivotable into an open position away from said first ring arm portion, said ring closeable by pivoting said second ring arm portion with said first distal end closeable to said second distal end, said ring carrier having means for resiliently urging said first distal end and said second distal end closed together, the improvement comprising:

said second ring arm portion having a substantially straight length, with a short portion adjacent said second distal end, said short portion turned toward said first ring arm portion, said second ring arm portion hingedly held onto said ring carrier and pivotable into an open position away from said first ring arm portion, with the straight length in a substantially vertical position, said short portion having a horizontal profile in an open position less than a corresponding horizontal clearance of said apertures for vertical downward loading of said pages, onto said second ring arm portion, said ring closable by pivoting said second ring arm portion with said fist distal end engageable to said second distal end.

2. The ring according to claim 1, wherein when said first ring arm portion and said second ring arm portion are spread apart, said second ring arm portion is arranged generally vertically with respect to said inside surface of said cover member.

3. The ring according to claim 1, wherein said short portion of said second ring arm portion, when said ring is in said open position, has a horizontal profile of approximately ¼ inch.

4. The ring according to claim 1, wherein said second ring arm portion comprises a second turned portion adjacent said second base end, said second turned portion arranged generally perpendicularly from said substantially straight length.

5. The ring according to claim 4, wherein when said first ring arm portion and said second ring arm portion are spread apart, said second ring arm portion is arranged generally vertically with respect to said inside surface of said cover member.

6. The ring according to claim 1, wherein said first distal end and said second distal end have displayed thereon complimentary irregular surfaces which, when said fist ring arm portion is closed to said second ring arm portion said complimentary irregular surfaces interengage to prevent lateral disengagement of said first ring arm portion and said second ring arm portion.

7. A ring binder for holding pages having apertures therethrough, comprising:

a top cover portion;

a spine cover portion;

a bottom cover portion, said top cover portion hingedly connected to said spine cover portion, said spine cover portion hingedly connected to said bottom cover portion;

a ring carrier mounted to an inside surface of said bottom cover member;

at least one ring held on said ring carrier member, said ring having a first ring arm and a second ring arm, said first ring arm and said second ring arm each having base ends and distal ends, said base ends of said ring arms mounted to said ring carrier and said distal ends arranged elevated away from said bottom cover portion and arrangeable to abut together when said ring is in a closed condition said ring carrier having means for urging said distal ends together when said ring is in a closed condition; and said first ring arm comprising a generally concave shape toward said second ring arm, and said second ring arm comprises a shape having a substantially straight length with a short portion adjacent said distal end of said second ring arm, said short portion angled off from said straight length toward said first ring arm, said second ring arm portion hingedly held onto said ring carrier and pivotable into an open position away from said first ring arm portion, with the straight length in a substantially vertical position, said short portion having a horizontal profile in open position less than a corresponding horizontal clearance of said apertures for vertical downward loading of said pages, onto said second ring arm portion.

8. The ring binder of claim 7, wherein said second ring arm comprises a turned portion at said base end, said turned portion arranged approximately perpendicularly to the substantially straight length of said second ring arm, said turned portion engaged to said ring carrier.

9. The ring binder of claim 8 wherein said means for urging comprises a resilient cover and a pair of hinged leaves, said resilient cover clasping around an outside dimension of said hinged leaves and resiliently holding said hinged leaves in a V condition either pointed downwardly or upwardly depending on the open or closed condition of said first and second ring arms, said first ring arm engaged at its base end to a first of said hinged leaves and said second ring arm engaged at its base end to a second of said hinged leaves.

10. The ring binder of claim 7, wherein when said ring is opened said short portion comprises a horizontal profile of approximately ¼", allowing pages with apertures of slightly greater than ¼" to be loaded onto said second ring arm in a generally vertically downward direction.

11. The ring binder of claim 7, wherein said first ring arm comprises a circular curvature.

12. The ring binder of claim 11, wherein when said first ring arm and said second ring arm are spread apart in a fully open condition said substantially straight length of said second ring arm is arranged perpendicularly to said bottom cover portion.

13. The ring binder of claim 12, wherein said second ring arm comprises a turned portion at said base end, said turned portion arranged approximately perpendicularly to the substantially straight length of said second ring arm, said turned portion engaged to said ring carrier.

14. The ring binder of claim 13, wherein when said ring is open, said short portion comprises a horizontal profile of approximately ¼".

15. The binder of claim 13, wherein said distal ends have irregular complimentary surfaces for preventing lateral displacement of the distal ends once abutted to each other.

16. A ring binder for holding pages having apertures therethrough, comprising:

a top cover portion;

a spine cover portion;

a bottom cover portion, said top cover portion hingedly connected to said spine cover portion, said spine cover portion hingedly connected to said bottom cover portion;

a ring carrier mounted to an inside surface of said bottom cover member;

at least one ring held on said ring carrier member, said ring having a first ring arm and a second ring arm, said first ring arm and said second ring arm each having base ends and distal ends, said base ends of said ring arms mounted to said ring carrier and said distal ends arranged elevated away from said bottom cover portion and arrangeable to abut together when said ring is in a closed condition; and said first ring arm comprising a generally concave shape toward said second ring arm, and said second ring arm comprises a shape having a substantially straight length with a short first turned portion adjacent said distal end of said second ring arm, said first turned portion angled off from said straight length toward said first ring arm, said second ring arm portion hingedly held onto said ring carrier and pivotable into an open position away from said first ring arm portion, with the straight length in substantially vertical position, said short portion having a horizontal profile in open position less than a corresponding horizontal clearance of said apertures for vertical downward loading of said pages, onto said second ring arm portion;

said ring carrier comprises a resilient cover and first and second hinged leaves, hinged together, said resilient cover clasping around an outside dimension of said hinged leaves and resiliently holding said hinged leaves in a V condition either pointed downwardly or upwardly depending on the open or closed condition of said first and second ring arms, said hinged leaves resiliently urging said distal ends together when said ring is in said closed condition, said first ring arm engaged at its base end to said first hinged leave and said second ring arm having its second turned portion arranged between said second hinged leave and said resilient cover and engaged at its base end to said second hinged leave.

17. The ring binder of claim 16, wherein when said ring is opened said first turned portion comprises a horizontal profile of approximately ¼", allowing pages with apertures of slightly greater than ¼" to be loaded onto said second ring arm in a generally vertically downward direction.

18. The ring binder of claim 16, wherein said resilient cover provides a notch therein allowing said second turned portion to proceed laterally through said resilient cover to be arranged between said second hinged leave and said resilient cover.

19. The ring binder of claim 18, wherein said second turned portion comprises a knob end at said base end, and said second turned portion proceeds through an aperture in said second hinged leave with said knob end arranged on an opposite side of said second hinged leave than said second turned portion, capturing said second hinged leave onto said second ring arm.

20. A method of loading pages into a ring binder comprising the steps of:

providing a D-shaped ring having an arcuate first leg and a substantially straight second leg, said first and second legs connected at base ends to a ring carrier, said substantially straight second leg having a short turned portion at a free end thereof, said arcuate leg and said substantially straight leg being pivotable at said ring carrier to selectively spread apart or close together with said short turned portion mating with a free end of said arcuate leg, said ring carrier providing means for resiliently urging said short turned portion and said free end together to hold closed said ring;

with the D-shaped ring in the open condition, loading a substantially horizontally positioned stack of pages having punched holes in vertical alignment substantially vertically downward onto the substantially straight leg, the straight leg extending substantially vertically and penetrating the holes; and closing said D-shaped ring.

21. The method according to claim 20 comprising the further step of:

providing a pivotable tray for holding the stack of pages, pivoting of the tray downward, to approximate the substantially vertical downward loading direction by a sweeping arc.

* * * * *